United States Patent [19]

Giffard

[11] Patent Number: 4,747,943

[45] Date of Patent: May 31, 1988

[54] SPLITTER ASSEMBLY

[75] Inventor: Phillip J. Giffard, Nerang, Australia

[73] Assignee: Mineral Deposits Limited, Australia

[21] Appl. No.: 902,441

[22] PCT Filed: Nov. 29, 1985

[86] PCT No.: PCT/AU85/00295

§ 371 Date: Jul. 30, 1986

§ 102(e) Date: Jul. 30, 1986

[87] PCT Pub. No.: WO86/03140

PCT Pub. Date: Jun. 5, 1986

[30] Foreign Application Priority Data

Nov. 30, 1984 [AU] Australia ..... PG8371

[51] Int. Cl.[4] ..... B03B 5/52

[52] U.S. Cl. ..... 209/459; 209/434; 209/493; 209/697

[58] Field of Search ..... 209/696, 697, 655, 211, 209/434, 441, 459, 460, 458, 493, 494, 495; 193/12, 13

[56] References Cited

U.S. PATENT DOCUMENTS

| | | | |
|---|---|---|---|
| 1,959,736 | 5/1934 | Rademacher | 209/697 |
| 2,145,315 | 1/1939 | Pardee | 209/697 |
| 2,331,850 | 10/1943 | Smith | 209/145 |
| 2,615,572 | 10/1952 | Hodge | 209/211 |
| 2,782,923 | 2/1957 | Cook, Jr. et al. | 209/127.4 |
| 4,128,474 | 12/1978 | Ennis | 209/211 |
| 4,189,378 | 2/1980 | Wright et al. | 209/459 |
| 4,505,811 | 3/1985 | Griffiths et al. | 209/459 |
| 4,664,789 | 5/1987 | Lees et al. | 209/459 |

FOREIGN PATENT DOCUMENTS

| | | | |
|---|---|---|---|
| 3233528 | 4/1984 | Fed. Rep. of Germany | 209/127.4 |
| WO82/03343 | 10/1982 | PCT Int'l Appl. . | |
| 457801 | 12/1936 | United Kingdom | 209/494 |
| 2046131 | 11/1980 | United Kingdom . | |
| 2098091 | 11/1982 | United Kingdom . | |

*Primary Examiner*—Robert B. Reeves
*Assistant Examiner*—Donald T. Hajec
*Attorney, Agent, or Firm*—Stevens, Davis, Miller & Mosher

[57] ABSTRACT

This invention relates to a spiral separator (1) which is used for separating particulate material and which is able, when arranged in a linear array of such separators, to be adjusted in concert with the other separators in the array.

Specifically the invention consists in a spiral separator (1) comprising a volute (2); a splitter blade (4) mounted below a discharge section (3) of the volute (2) for selected rotation about a substantially horizontal axis (5) parallel to the direction of flow in the volute (2), splitting being adjusted by the rotation of the splitter blade (2) about the axis (5).

10 Claims, 3 Drawing Sheets

SPLITTER ASSEMBLY

BACKGROUND OF THE INVENTION

1. Field of the Invention .

The present invention relates to spiral separators used for separating particulate materials having different specific gravities, and specifically to spiral separators having a splitter assembly adjacent the discharge end of a volute adapted to segregate the material separated by the spiral separator.

2. Description of the Prior Art

In some separators the blade is mounted for translation in a radial direction as is described in Australian Application No. 37175/78. Other separators have been provided with a splitter blade which is mounted for rotation about an axis normal to the floor of the volute, that is to say substantially parallel to the axis of the volute. In such cases the position of separation is adjusted by rotating the splitter blade about its axis. A portion of the splitter blade upstream of the axis, upon rotation, tranverses the volute, and so adjustment is achieved.

Splitter assemblies as above described are adequate in some respects. However, when such splitter assemblies are used in multiple spiral separators which have more than one volute, whether the volutes are disposed in multi-start threaded arrangement or in adjacently wrapped arrangement, the separate adjustment of all splitters is tedious and inaccurate, and if an interlinking mechanism is installed, is complex. This complexity is undesirable as such mechanisms are expensive to manufacture, and difficult to maintain, particularly in harsh environments such as are commonly found in the vicinity of spiral separators.

It is an object of the present invention to overcome or at least ameliorate the shortcomings of the prior art by simple means.

SUMMARY OF THE INVENTION

The present invention consists in a spiral separator comprising:

a volute;

a splitter blade mounted below a discharge section of the volute for selected rotation about a substantially horizontal axis generally parallel to the direction of flow in the volute, splitting being adjusted by the rotation of said splitter blade about said axis.

In a preferred form, the spiral separator includes a compartmented collection vessel below the discharge section of the volute. When a plurality of spiral separators are disposed in a linear array, the corresponding splitters may be mounted on a common axis and a common collection vessel may be used for all of the separators in the array.

BRIEF DESCRIPTION OF THE DRAWINGS

The present invention will now be described by way of example only with reference to the accompanying drawings in which.

DESCRIPTION OF THE PREFERRED EMBODIMENT

Figure 1:
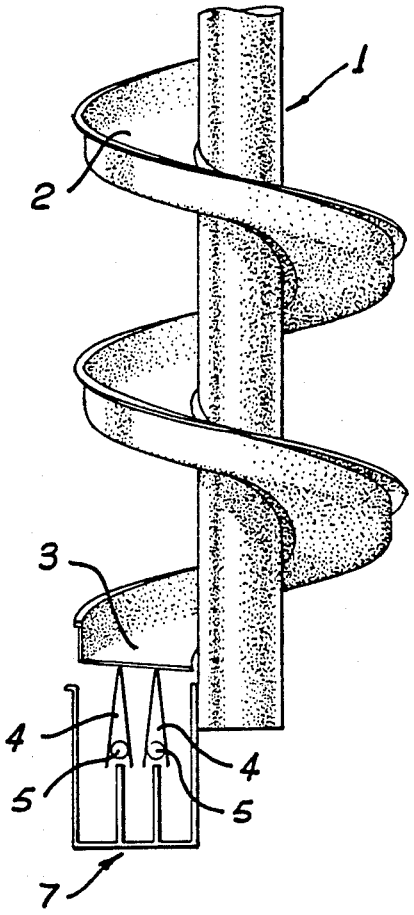
FIG. 1 is a side elevation of a spiral separator according to the present invention.
Figure 2:
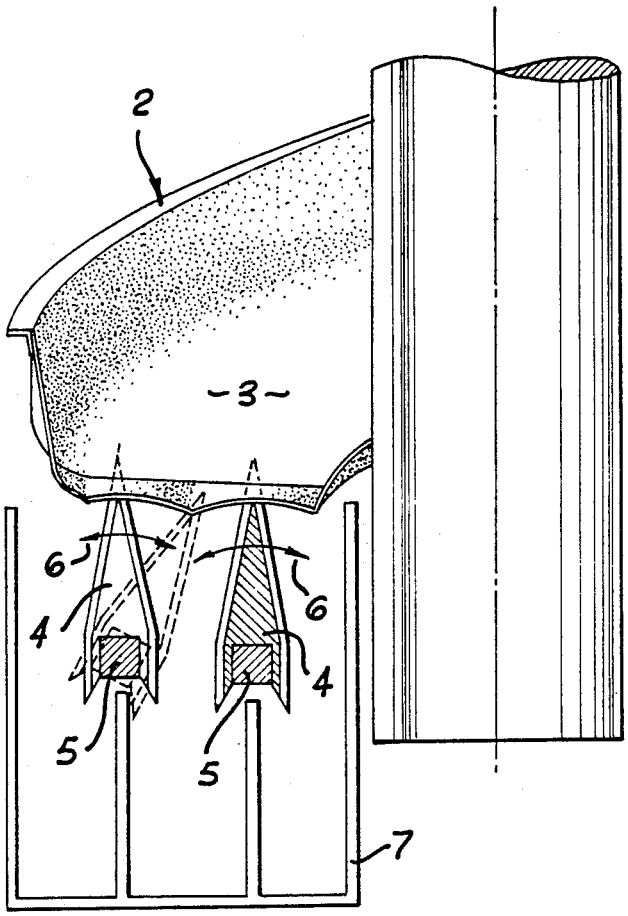
FIG. 2 is an enlarged, partly sectioned segment of part of the spiral separator of FIG. 1.

Referring to the drawings, a spiral separator 1 comprises a volute 2 having a discharge end 3, and two splitter blades 4 at the discharge end 3. The splitter blades 4 are each mounted for selected rotation about substantially horizontal axes 5 which extend below the volute and generally parallel to a direction of flow within the volute at the discharge end 3. That is to say, the axes extend in a direction substantially parallel to the direction of motion of particulate material leaving the discharge end 3 of the volute 2. Rotation of the splitter blades 4 about axes 5, as indicated by arrows 6, effects the adjustment of the location of separation at the discharge end 3 of the volute 2.

A compartmented collection vessel 7 is located below the splitter blades 4 to collect material separated by the splitter blades 4.

The inclination of the splitter blades 4 may be adjusted and set by a lockable operating lever 8 which is connected with the splitter blades 4 by a shafts 9.

Figure 3:
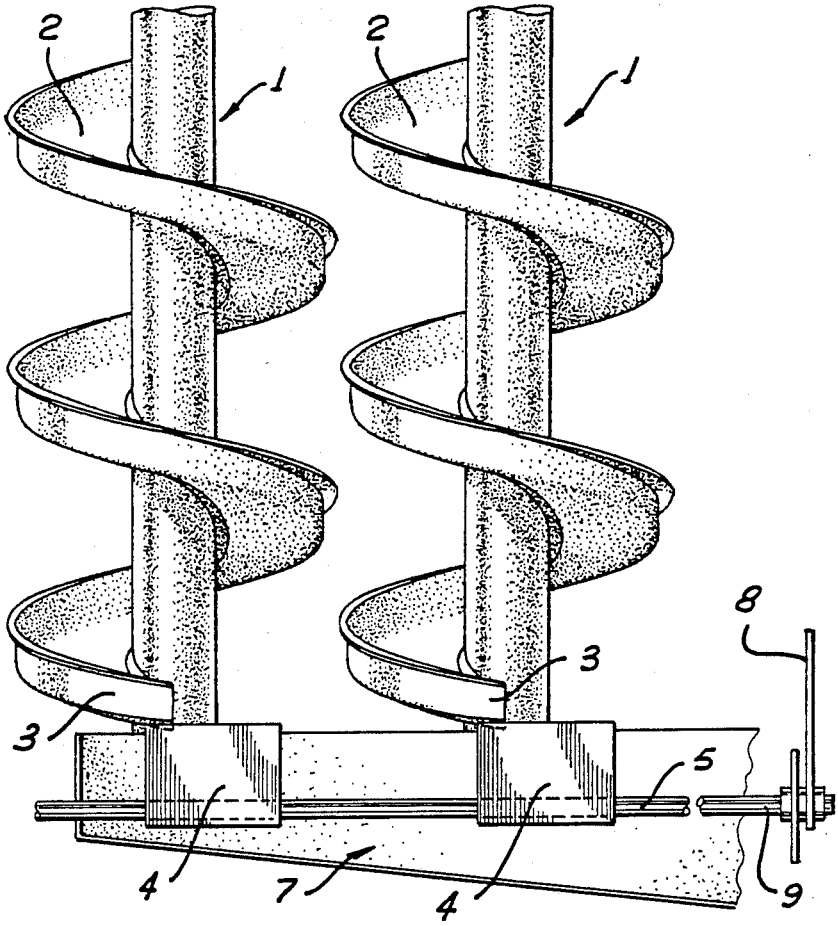
FIG. 3 is a side elevation showing two spiral separators according to the present invention in linear array.

A plurality of spiral separators according to the present invention may be arranged in linear array, in which case a single shaft 9 as shown in FIG. 3 may operate a like plurality of ganged splitter blades 4. In this case the collection vessel 7 extends beneath each of the separators in the linear array. If the ground on which the array is located is inclined then the substantially horizontal axis 5 may be equally inclined.

The present invention extends to spiral separators having two or more volutes disposed one above the next. In such cases two sets of splitter blades and corresponding control mechanisms may be required.

The volutes may terminate in a sharp edge to ensure clean discharge without undesirable flow attachment. This edge may be formed to permit clearance between the splitter and the edge. If the edge is formed from a resiliant material slight interference may be beneficial.

While the splitter blades, shown herein, are of the simplest shape, it is envisaged that they may be modified, for instance, to increase in height in the direction of flow, or to include baffles to assist in diverting the flow from the volute into the collection vessel.

I claim:

1. A plurality of spiral separators for separation of particulate material and disposed in a linear array comprising:

a plurality of volute-shaped chutes each having a discharge section at its lower end;

a splitter blade mounted vertically below each said discharge section of the chute with each said splitter blade being in the flow of material leaving its respective chute, said splitter blade being mounted for selected rotation about a substantially horizontal axis extending generally parallel to the direction of flow of particulate material in the chute, splitting being adjusted by the rotation of each said splitter blade about said axis so that splitting occurs after the slurry has left the discharge section of said chute; a shaft connected to a plurality of said splitter blades and extending along said linear array so that rotation of said shaft effects rotation of a plurality of splitter blades.

2. Spiral separators according to claim 1 including a compartmented collection vessel disposed below at least some of said splitter blades and the discharge section of said chute.

3. Spiral separators according to claim 2 wherein said splitter blades are mounted on said shaft to rotate therewith.

4. Spiral separators according to claim 3 wherein a lockable operating lever is connected with said splitter blades by said shaft.

5. Spiral separators according to claim 1 including a second splitter blade disposed substantially adjacent said first splitter blade which second splitter blade is adapted to rotate about a respective second axis extending substantially parallel to the axis of the first splitter blade.

6. Spiral separators according to claim 5 wherein the second splitter blade is mounted on a respective second shaft to rotate therewith.

7. Spiral separators according to claim 6 including a second operating lever connected with said second splitter blade by its respective shaft.

8. Spiral separators according to claim 1 including a plurality of second splitter blades each disposed substantially adjacent the first splitter blade to rotate about further respective axes each extending substantially parallel to that of the first splitter blade.

9. A plurality of spiral separators according to claim 1 wherein a single compartmented collection vessel extends beneath the discharge section of each separator in said array.

10. A plurality of spiral separators for separation of particulate material and disposed in a linear array comprising:

a plurality of volute-shaped chutes each having a discharge section at its lower end;

at least one collection vessel spaced vertically below said discharge sections, said at least one collection vessel having at least one interior wall dividing the vessel into at least two compartments;

a generally horizontally extending shaft mounted for rotation generally vertically above said at least one interior wall;

a plurality of splitter blades vertically mounted on said shaft above said interior wall so as to each be located between said discharge sections and said collection vessel with the upper ends of said splitter blades being directed into a stream of slurry flowing from said discharge sections so that the flow is split after it leaves the discharge sections, and so that rotation of said shaft effects rotation of a plurality of splitter blades.

* * * * *